US009486676B1

(12) United States Patent
Thall et al.

(10) Patent No.: US 9,486,676 B1
(45) Date of Patent: Nov. 8, 2016

(54) GOLF CLUB WITH DRAG REDUCTION SURFACING

(71) Applicants: Nelson B. Thall, Toronto (CA); Henry B. Thall, Toronto (CA)

(72) Inventors: Nelson B. Thall, Toronto (CA); Henry B. Thall, Toronto (CA)

( * ) Notice: Subject to any disclaimer, the term of this patent is extended or adjusted under 35 U.S.C. 154(b) by 366 days.

(21) Appl. No.: 14/196,677

(22) Filed: Mar. 4, 2014

(51) Int. Cl.
*A63B 53/04* (2015.01)
*A63B 53/00* (2015.01)
*A63B 53/10* (2015.01)

(52) U.S. Cl.
CPC ..... *A63B 53/04* (2013.01); *A63B 53/00* (2013.01); *A63B 53/10* (2013.01)

(58) Field of Classification Search
USPC ..... 473/317–350
See application file for complete search history.

(56) References Cited

U.S. PATENT DOCUMENTS 1,125,029 A * 1/1915 Lard ..... A63B 53/14 191/64
1,218,091 A * 3/1917 Lard ..... A63B 53/14 473/298
1,232,816 A * 7/1917 Lard ..... A63B 53/14 428/573
1,418,038 A * 5/1922 Tousey ..... A63B 53/10 473/317
1,996,298 A * 4/1935 Lard ..... A63B 53/00 473/316
2,150,737 A * 3/1939 Chittick ..... A63B 53/12 473/315
D236,639 S * 9/1975 Kanne ..... 473/316
D236,735 S * 9/1975 Bush ..... 473/316
3,997,170 A * 12/1976 Goldberg ..... A63B 53/04 473/327
4,065,133 A * 12/1977 Gordos ..... A63B 53/04 473/327
4,106,777 A * 8/1978 Kim ..... A63B 53/12 280/819
4,648,598 A * 3/1987 Kim ..... A63B 53/12 428/34.1
4,754,974 A * 7/1988 Kobayashi ..... A63B 53/04 473/327
4,850,593 A 7/1989 Nelson
5,190,289 A * 3/1993 Nagai ..... A63B 53/00 473/327
5,354,056 A * 10/1994 Cornish, III ..... A63B 53/10 273/DIG. 6
5,688,186 A * 11/1997 Michaels ..... A63B 53/04 473/290
5,700,208 A * 12/1997 Nelms ..... A63B 53/04 473/324
5,795,244 A * 8/1998 Lu ..... A63B 53/10 473/317
6,001,029 A * 12/1999 Kobayashi ..... A63B 53/04 473/327
6,224,497 B1 * 5/2001 Antonious ..... A63B 53/04 473/330
6,348,011 B1 * 2/2002 Reyes ..... A63B 53/04 427/422
6,398,665 B1 * 6/2002 Antonious ..... A63B 53/04 473/330
6,428,426 B1 * 8/2002 Helmstetter ..... A63B 53/04 473/329
6,428,427 B1 * 8/2002 Kosmatka ..... A63B 53/04 473/330
6,520,867 B1 * 2/2003 Miura ..... A63B 53/10 473/316
6,602,150 B1 * 8/2003 Kosmatka ..... A63B 53/04 473/332

(Continued)

FOREIGN PATENT DOCUMENTS

JP 10295858 A * 11/1998
JP 2001129135 A * 5/2001
JP 2004299170 A * 10/2004

*Primary Examiner* — Alvin Hunter
(74) *Attorney, Agent, or Firm* — Crossley & Stevenson Intellectual Property Law

(57) ABSTRACT

A golf club producing less drag on a golf club during a swing than a conventional golf club with drag-reducing structures having different surface areas on specific portions of the golf club, the structures divided into a first portion on a shank, a peripheral portion surrounding a ball impact face, an upper surface, toe, hosel, rear face, sole, and heel of the club head; a second portion on a forward face outer portion; third and fourth portions on a respective impact face second ring and first ring; and a fifth portion centered on the impact face. The structure surface area progressively decreases from the fifth portion, to the fourth portion and then to the third portion. Each drag-reducing structure of the first and third portions has an equal surface area, while each structure of the second portion has a surface area larger than each structure of the first portion.

6 Claims, 5 Drawing Sheets

(56) References Cited

U.S. PATENT DOCUMENTS 6,605,007 B1 * 8/2003 Bissonnette ..... A63B 53/0466 473/329
6,695,711 B2 * 2/2004 Blough ..... A63B 53/12 29/421.1
6,776,725 B1 * 8/2004 Miura ..... A63B 53/0466 473/327
6,863,626 B2 * 3/2005 Evans ..... A63B 53/02 473/329
6,881,157 B2 * 4/2005 Hsien ..... A63B 53/10 473/317
7,059,972 B2 * 6/2006 Miyamoto ..... A63B 53/04 473/330
7,220,190 B2 * 5/2007 Hirano ..... A63B 53/0466 473/330
7,575,527 B2 * 8/2009 Davis ..... A63B 59/50 473/317
7,682,262 B2 * 3/2010 Soracco ..... A63B 60/42 473/329
7,753,808 B2 * 7/2010 Matsunaga ..... A63B 53/0466 473/329
8,007,372 B2 * 8/2011 Long ..... A63B 53/0466 473/330
8,025,589 B2 * 9/2011 Brinton ..... A63B 53/00 473/290
8,317,636 B2 11/2012 Evans et al.
8,329,081 B2 12/2012 Morgan et al.
8,968,115 B2 * 3/2015 Park ..... A63B 53/04 473/331

* cited by examiner

GOLF CLUB WITH DRAG REDUCTION SURFACING

BACKGROUND OF THE INVENTION

The majority of drag associated with golf clubs results from the separation of airflow causing what is commonly known as pressure drag. Air flowing past a traditional smooth exterior golf club separates quickly thereby resulting in a high pressure drag. Various types of golf clubs with aerodynamic features that reduce the drag while swinging are known in the prior art. Most of the prior art patents focus only on the club head for an improved drag coefficient. The prior club head improvements center on the dimensional relationships of the driver head based on the location of apex and nadir points as well as a redesign of the club face body dimensions, the shapes of various surfaces of the club head, and on the texturing of the sole, heel, and the top side, rather than on the club face to address the aerodynamic performance of the golf club. One of the previous patents teaches a hosel end portion of a golf club shaft shank having a profile roughness of between about 4.3 microns and about 5.0 microns to reduce surface airflow and turbulence over a golf club shaft surface during the downswing phase of the golf swing at maximum velocity. However, what is needed is a golf club with drag reduction surfacing that produces delayed airflow separation and therefore, less pressure drag on the golf club member during a golf swing than a conventional golf club member by providing drag-reducing structures having different surface areas on specific portions of the golf club member. The structure of the present golf club delays airflow separation which, in turn, results in a smaller airflow separation region when compared to traditional golf club designs as well as prior golf club having aerodynamic features. The delayed airflow separation during a golf swing decreases the pressure drag on the golf club member.

FIELD OF THE INVENTION

The present invention relates to golf clubs, and more particularly, to a golf club with drag reduction surfacing.

SUMMARY OF THE INVENTION

The general purpose of the present golf club with drag reduction surfacing, described subsequently in greater detail, is to provide a golf club with drag reduction surfacing which has many novel features that result in a golf club with drag reduction surfacing which is not anticipated, rendered obvious, suggested, or even implied by prior art, either alone or in combination thereof.

To accomplish this, the present golf club with drag reduction surfacing includes a golf club member, such as a driver, a wood, or an iron. For proper reference, the golf club member has a shaft and a club head mounted at a lower extremity of the shaft with the shaft having a shank and a grip. A plurality of drag-reducing structures is continuously disposed on an entire exterior surface of each of the shaft shank and the club head. The drag-reducing structures on a single golf club member are either all grooves or all protrusions. The drag-reducing structures are divided into various portions that are disposed on particular areas of the shaft shank and the club head to produce a delay in airflow separation and therefore, decreased pressure drag on the golf club member during a golf swing through the air than a conventional golf club member having smooth surfacing or having drag-reducing structures on only a portion of the golf club member. The reduction in pressure drag on the golf club member enhances the speed and control of movement of the golf club member during a golf swing which, in turn, increases the distance and accuracy of travel of a golf ball after being struck by the club head. The drag-reducing structures of the instant golf club add more kinetic energy to the airflow by delaying airflow separation which, in turn, reduces pressure drag.

To better describe the present device, the club head includes a forward face, an upper surface, a toe, a hosel, a rear face, a sole, and a heel. The forward face includes a centrally disposed ball impact face and a peripheral portion surrounding the ball impact face. The ball impact face of the present golf club member includes a round central area, commonly referred to as the sweet spot of the club head, a first ring concentrically disposed around the central area, a second ring concentrically disposed around the first ring, and an outer portion disposed between the second ring and the peripheral portion.

The drag-reducing structures are divided into a first portion, a second portion, a third portion, a fourth portion, and a fifth portion. The first portion is disposed on the shaft shank and each of the peripheral portions surrounding the ball impact face, the upper surface, the toe, the hosel, the rear face, the sole, and the heel of the club head. The second portion is disposed on the outer portion of the forward face. The third portion is disposed on the second ring of the ball impact face. The fourth portion is disposed on the first ring of the ball impact face. The fifth portion is disposed on the central area of the ball impact face.

The drag-reducing structures of each of the third portion, the fourth portion, and the fifth portion progressively decrease in surface area from the fifth portion to the third portion progressively decrease in surface area with the third portion drag-reducing structures having the largest surface area. Each of the first portion drag-reducing structures has a same surface area as the surface area of the third portion drag-reducing structures. Each of the second portion drag-reducing structures has a larger surface area than the first portion drag-reducing structures. Each drag-reducing structure has a cross-section being one of a geometrical shape. As illustrated, the geometrical shape of the cross-section is circular; however, the geometrical shape of the cross-section can also be oval-shaped, square, rectangular, hexagonal, pentagonal, or other geometrical shapes.

Thus has been broadly outlined the more important features of the present golf club with drag reduction surfacing so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

With reference now to the drawings, and in particular FIGS. 1 through 4 and 5B thereof, the instant golf club with drag reduction surfacing employing the principles and concepts of the present golf club with drag reduction surfacing and generally designated by the reference number 10 will be described.

Figure 1:
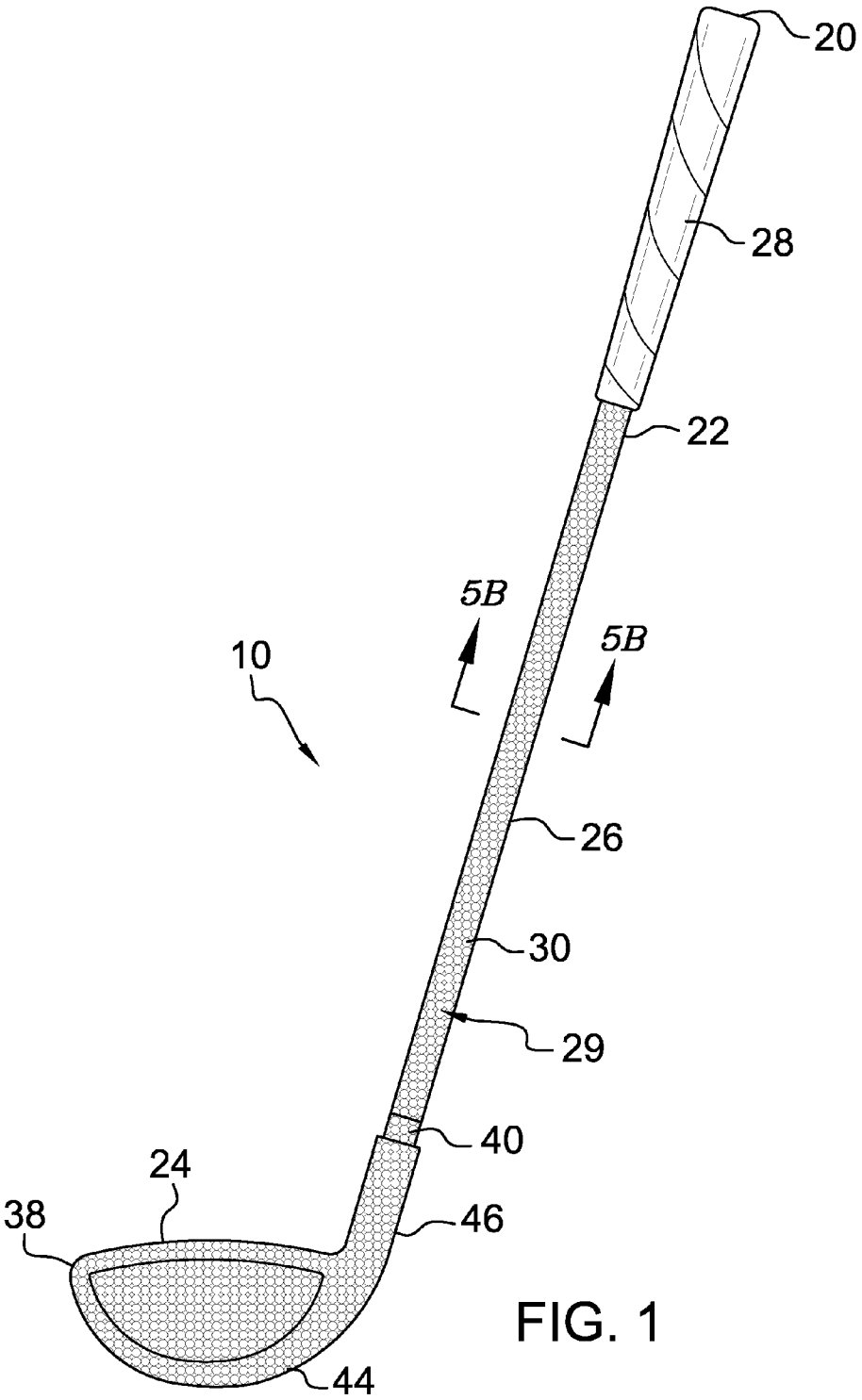
FIG. 1 is a front isometric view.
Figure 2:
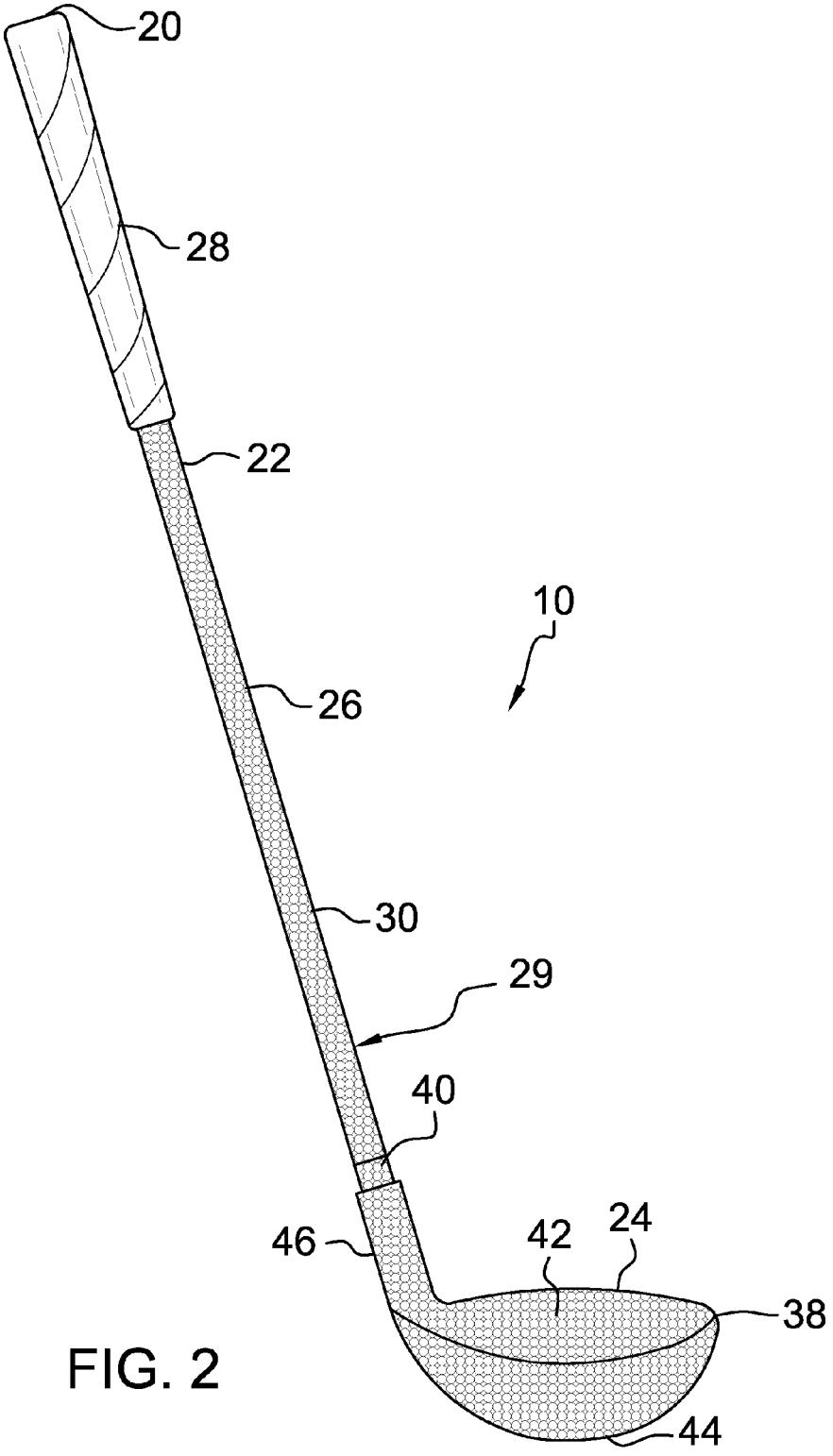
FIG. 2 is a rear isometric view.
Figure 3:
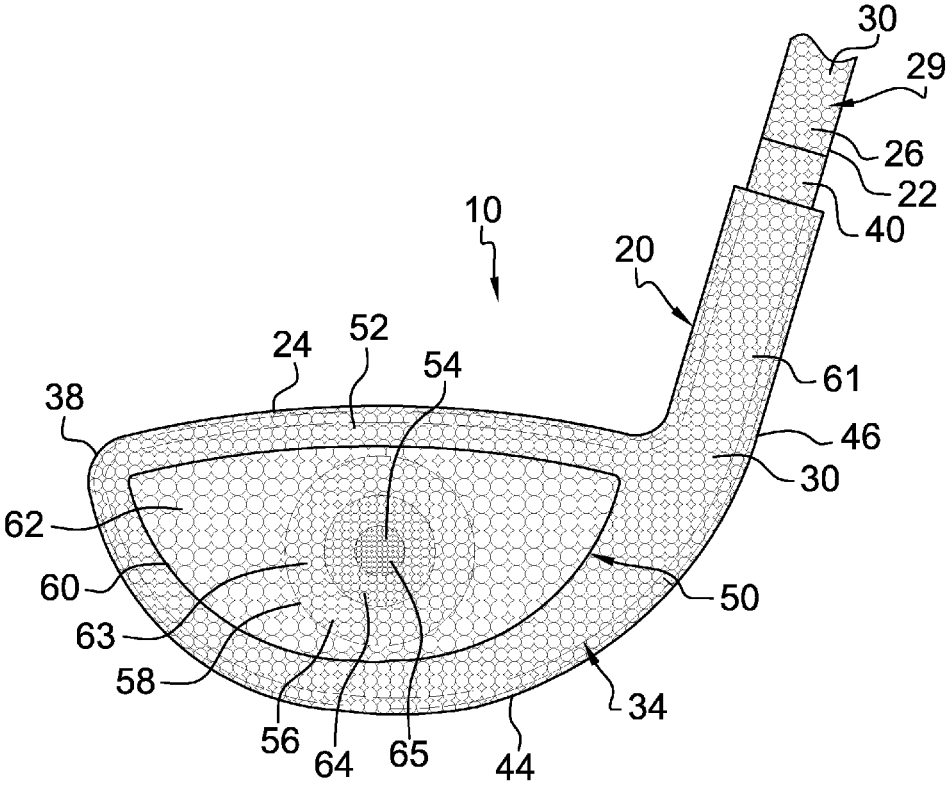
FIG. 3 is a front elevation view of a club head.
Figure 4:
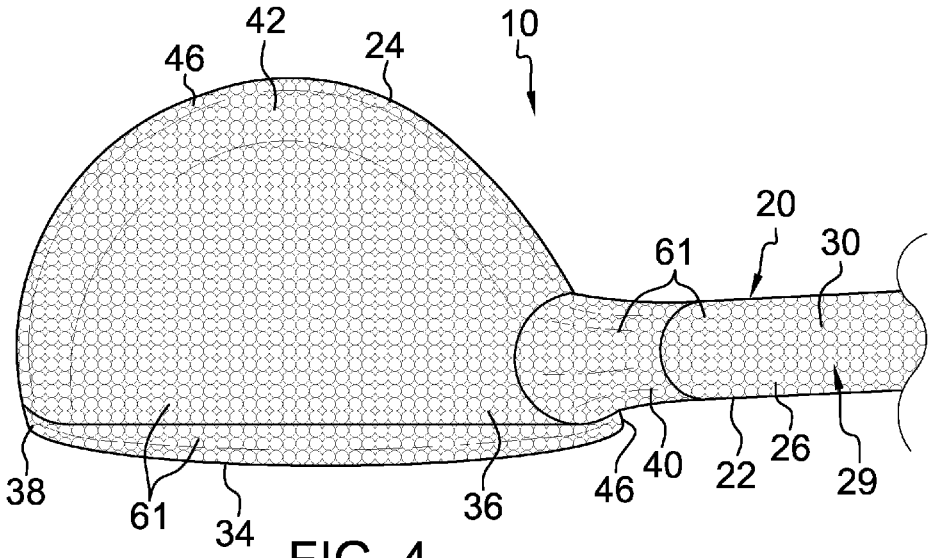
FIG. 4 is a top plan view of the club head.
Figure 5A:
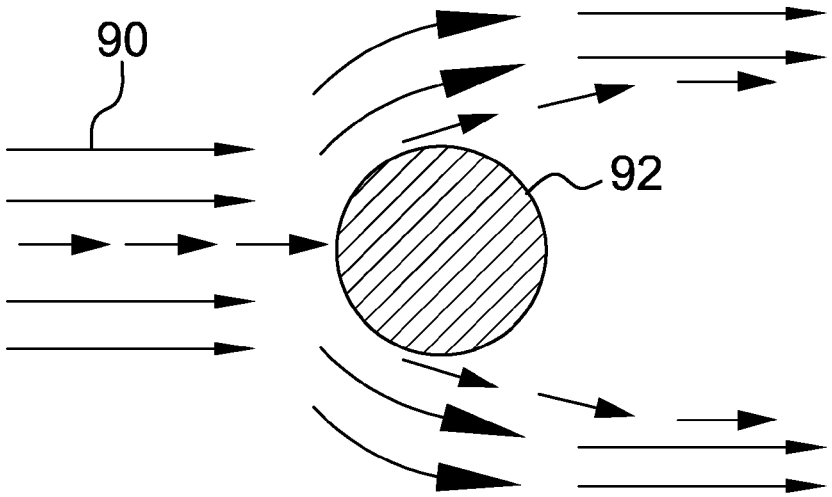
FIG. 5A is a cross-sectional view of a golf club shaft without drag reduction surfacing that results airflow separation early during a golf swing.
Figure 5B:
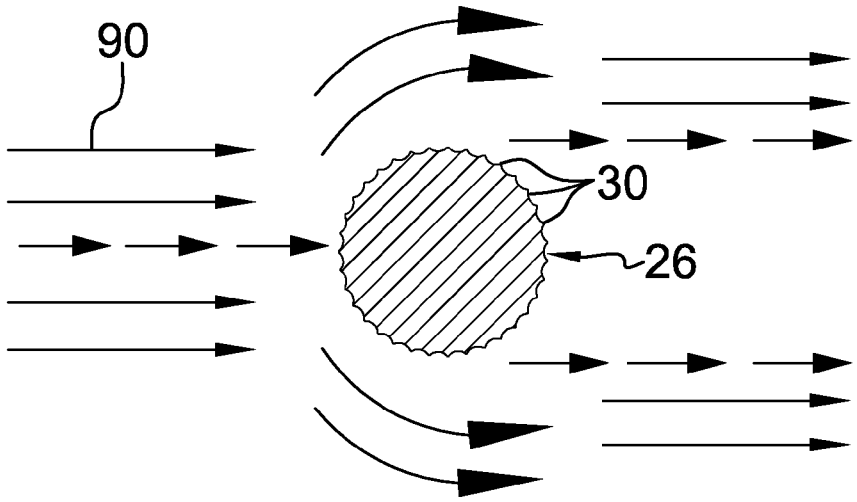
FIG. 5B is a cross-sectional view taken along line 5B-5B of FIG. 1 showing drag reduction surfacing that results in delayed airflow separation during a golf swing.

Referring to FIGS. 1 through 4 and 5B, the present golf club with drag reduction surfacing 10 is illustrated. The golf club with drag reduction surfacing 10 includes a golf club member 20. The golf club member 20 can be any one of a driver, a wood, or an iron. The golf club member 20 has a shaft 22 and a club head 24 mounted at a lower extremity of the shaft 22. The shaft 22 has a shank 26 and a grip 28. Each of the shaft 22 shank 26 and the club head 24 has an exterior surface 29. A plurality of drag-reducing structures 30 is continuously disposed on the entire exterior surface 29 of each of the shaft 22 shank and the club head 24. The drag-reducing structures 30 on a single golf club member 20 are either all grooves or all protrusions. The drag-reducing structures 30 are divided into various portions that are disposed on particular areas of the shaft 22 shank 26 and the club head 24 to produce a delay in airflow 90 separation as shown in FIG. 5B. The pressure drag is thus reduced on the golf club member 20 during a golf swing through the air as shown in FIG. 5B and is less than a conventional golf club member 92 having smooth surfacing or drag-reducing structure on only a portion of the golf club member, as shown in FIG. 5A. The reduction in pressure drag on the golf club member 20 enhances the speed and control of movement of the golf club member 20 during a golf swing which, in turn, increases the distance and accuracy of travel of a golf ball after being struck by the club head 24.

To better describe the present device 10, the club head 24 includes a forward face 34, an upper surface 36, a toe 38, a hosel 40, a rear face 42, a sole 44, and a heel 46. The forward face 34 includes a centrally disposed ball impact face 50 and a peripheral portion 52 surrounding the ball impact face 50. The ball impact face 50 of the present golf club member 20 includes a round central area 54, commonly referred to as the sweet spot of the club head 24, a first ring 56 concentrically disposed around the central area 54, a second ring 58 concentrically disposed around the first ring 56, and an outer portion 60 disposed between the second ring 58 and the peripheral portion 52.

The drag-reducing structures 30 are divided into a first portion 61, a second portion 62, a third portion 63, a fourth portion 64, and a fifth portion 65. The first portion 61 is disposed on the shaft 22 shank 26 and each of the peripheral portion 52 surrounding the ball impact face 50, the upper surface 36, the toe 38, the hosel 40, the rear face 42, the sole 44, and the heel 46 of the club head. The second portion 62 is disposed on the outer portion 60 of the forward face 34. The third portion 63 is disposed on the second ring 58 of the ball impact face 50. The fourth portion 64 is disposed on the first ring 56 of the ball impact face 50. The fifth portion 65 is disposed on the central area 54 of the ball impact face 50.

Each of the third portion 63, the fourth portion 64, and the fifth portion 65 of the drag-reducing structures 30 progressively decrease in surface area with the third portion 63 drag-reducing structures 30 having the largest surface area of the third, fourth, and fifth portions 63, 64, 65. Each of the drag-reducting structures 30 of the first portion 61 has a same surface area as the surface area of the drag-reducing structures 30 of the third portion 63. Each of the drag-reducing structures 30 of the second portion 62 has a larger surface area than the drag-structures 30 of the first portion 61. Each drag-reducing structure 30 has a cross-section being one of a geometrical shape. As illustrated, the geometrical shape of the cross-section is circular; however, the geometrical shape of the cross-section can also be oval-shaped, square, rectangular, hexagonal, pentagonal, or other geometrical shapes.

What is claimed is:

1. A golf club with drag reduction surfacing comprising:

a golf club member having a shaft and a club head mounted at a lower extremity of the shaft, the shaft having a shank and a grip, the club head having a forward face, an upper surface, a toe, a hosel, a rear face, a sole, and a heel, the forward face comprising a centrally disposed ball impact face and a peripheral portion surrounding the ball impact face;

a round central area of the ball impact face;

a first ring of the ball impact face concentrically disposed around the central area;

a second ring of the ball impact face concentrically disposed around the first ring;

an outer portion of the ball impact face disposed between the second ring and the peripheral portion;

an exterior surface on each of the shaft shank and the club head; and a plurality of drag-reducing structures continuously disposed on the entire exterior surface of each of the shaft shank and the club head, the plurality of drag-reducing structures disposed on the golf club member being one of all grooves or all protrusions, the plurality of drag-reducing structures comprising:

a first portion of the drag-reducing structures disposed on the shaft shank and each of the peripheral portion surrounding the ball impact face, the upper surface, the toe, the hosel, the rear face, the sole, and the heel of the club head;

a second portion of the drag-reducing structures disposed on the outer portion;

a third portion of the drag-reducing structures disposed on the second ring;

a fourth portion of the drag-reducing structures disposed on the first ring;

a fifth portion of the drag-reducing structures disposed on the central area;

wherein each of the fifth portion, the fourth portion, and the third portion of the drag-reducing structures progressively decrease in surface area with the third portion of the drag-reducing structures having the largest surface area and the fifth portion of the drag-reducing structures having the smallest surface area.

2. The golf club with drag reduction surfacing of claim 1:

wherein each of the drag-reducing structures of the first portion has a same surface area as the surface area of the drag-reducing structures of the third portion;

wherein each of the drag-reducing structures of the second portion has a larger surface area than the drag-reducing structures of the first portion.

3. The golf club with drag reduction surfacing of claim 2 comprising a cross-section of the drag-reducing structures being one of a geometrical shape.

4. The golf club with drag reduction surfacing of claim 3 wherein the geometrical shape of the cross-section is circular.

5. The golf club with drag reduction surfacing of claim 1 comprising a cross-section of each of the drag-reducing structures being one of a geometrical shape.

6. The golf club with drag reduction surfacing of claim 5 wherein the geometrical shape of the cross-section is circular.

* * * * *